US006086395A

United States Patent [19]

Lloyd et al.

[11] Patent Number: 6,086,395

[45] Date of Patent: Jul. 11, 2000

[54] POWER TRANSFORMER

[75] Inventors: Grant H. Lloyd; John Daniel Bean, both of Lawrenceville, Ga.

[73] Assignee: Motorola, Inc., Schaumburg, Ill.

[21] Appl. No.: 09/127,802

[22] Filed: Aug. 2, 1998

[51] Int. Cl.[7] ..... H01R 29/00

[52] U.S. Cl. ..... 439/172; 439/518; 363/146

[58] Field of Search ..... 439/172, 171, 439/173, 518, 956, 176; 363/146, 141, 143, 144

[56] References Cited

U.S. PATENT DOCUMENTS 5,613,863 3/1997 Klaus et al. ..... 439/172
5,634,806 6/1997 Hahn ..... 439/172
5,660,554 8/1997 Mead ..... 439/172
5,684,689 11/1997 Hahn ..... 439/172
5,829,993 11/1998 Wu ..... 439/172

*Primary Examiner*—Paula Bradley
*Assistant Examiner*—Briggitte R. Hammond
*Attorney, Agent, or Firm*—Philip H. Burrus, IV

[57] ABSTRACT

A power transformer is described comprising a housing with a catchment on its face and a catchment on its side and an adapter plug whose back side fits over the face and the side of the housing. The adapter plug has a projection on its face, and a projection on its side which includes a ridge at the distal end. The projection on the face of the adapter plug fits into the catchment on the face of the housing, and the projection on the side of the adapter plug fits into the catchment on the side of the housing and is restrained therein. The face of the adapter plug comprises a plug configuration selected from the group consisting of international electrical plug configurations.

2 Claims, 8 Drawing Sheets

POWER TRANSFORMER

TECHNICAL FIELD

This invention relates in general to power transformers, and more particularly to power transformers of the type used with power supplies found in different regions of the world.

BACKGROUND OF THE INVENTION

Power transformers are used to convert an alternating current power supply of the type available in homes, offices, hotels, and the like via an ordinary wall outlet to a direct current power supply compatible with electronic devices, such as radios-telephones, telephones, answering machines, calculators, computers, radios, and the like. These power transformers are used to reduce the dependence upon batteries or to provide charging energy for rechargeable batteries from available alternating current power supplies. To provide the regulated power supply, the transformer includes a power converting circuit within the housing having a male connector positioned thereon. The male connector is for a connection to a female connector of a main power supply wall outlet.

Because power transformers are often used with portable devices, they have been developed to facilitate transport with the portable devices. One known transformer includes pivoting prongs that move into the transformer housing for storage during travel, and pivot to an outwardly projecting position for connection to a wall outlet. These connectors have improved the compactness when folded to minimize the storage space which they require, thereby facilitating packing by travelers or commuters.

A difficulty encountered by international travelers is powering their electronic equipment. This difficulty arises because the power supplies in different countries have different voltages, currents, and supply frequency characteristics. They also have different wall outlet female connector configurations. Although power converter circuits have been developed which produce a regulated direct current voltage (e.g. 5 volts) from most main power supply signals found throughout the world, accommodating the different female connectors has been more difficult.

DETAILED DESCRIPTION OF THE PREFERRED EMBODIMENT

The present invention is a power transformer comprising a housing and an adapter plug for international outlets. The housing is a roughly rectangular box with a catchment on its face and side, while the adapter plug is L-shaped, its front face has prongs to fit in a wall outlet, while the back fits over the face and side of the housing. The adapter plug has a projection at each end of its L-shape. The projection on the side of the adapter plug includes a ridge at its distal end to slide into the catchment on the side of the housing. The catchment on the face of the housing permits the adapter plug protrusion on the face of the adapter plug to be inserted therein. The adapter plug can then be rotated first to the housing whereon the protrusion on the side of the adapter plug fits into the catchment on the side. A male electrical contact in the face of the housing mates with a female electrical contact within the back of the plug when the plug is fitted onto the housing.

Figure 1:
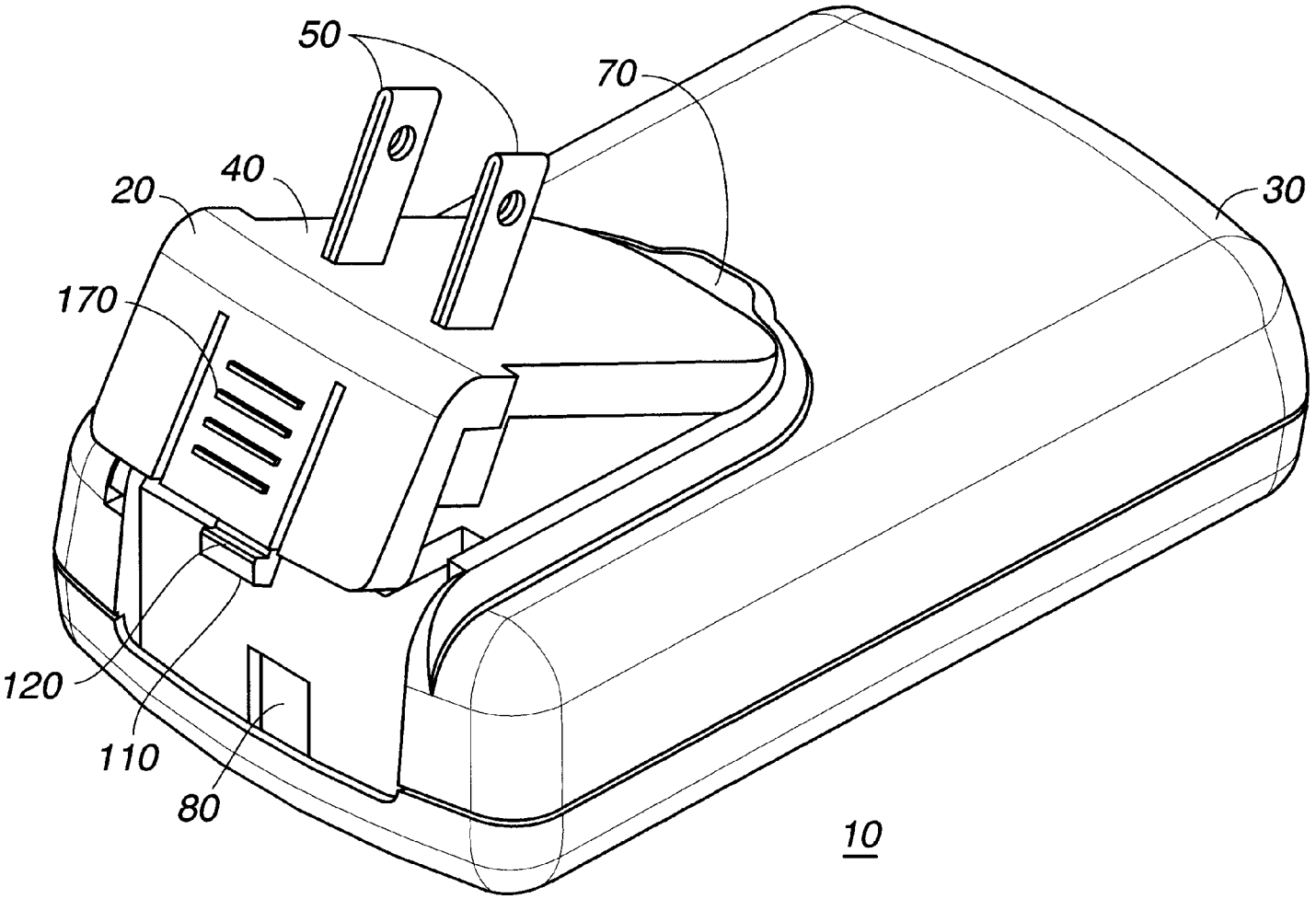
FIG. 1 is a perspective view of the power transformer of the present invention.
Figure 2:
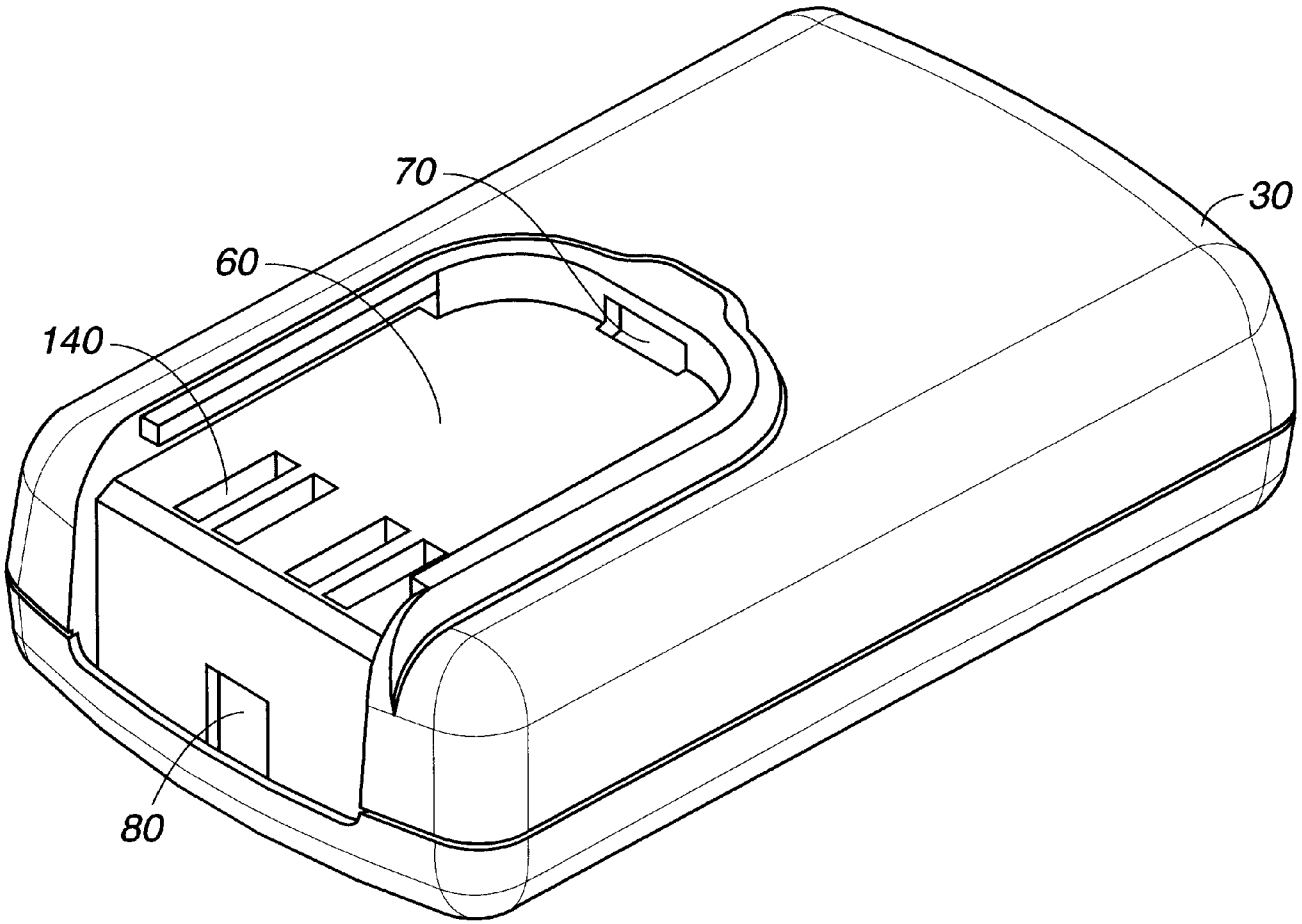
FIG. 2 is a perspective view of the housing of the present invention with the adapter plug removed.
Figure 3:
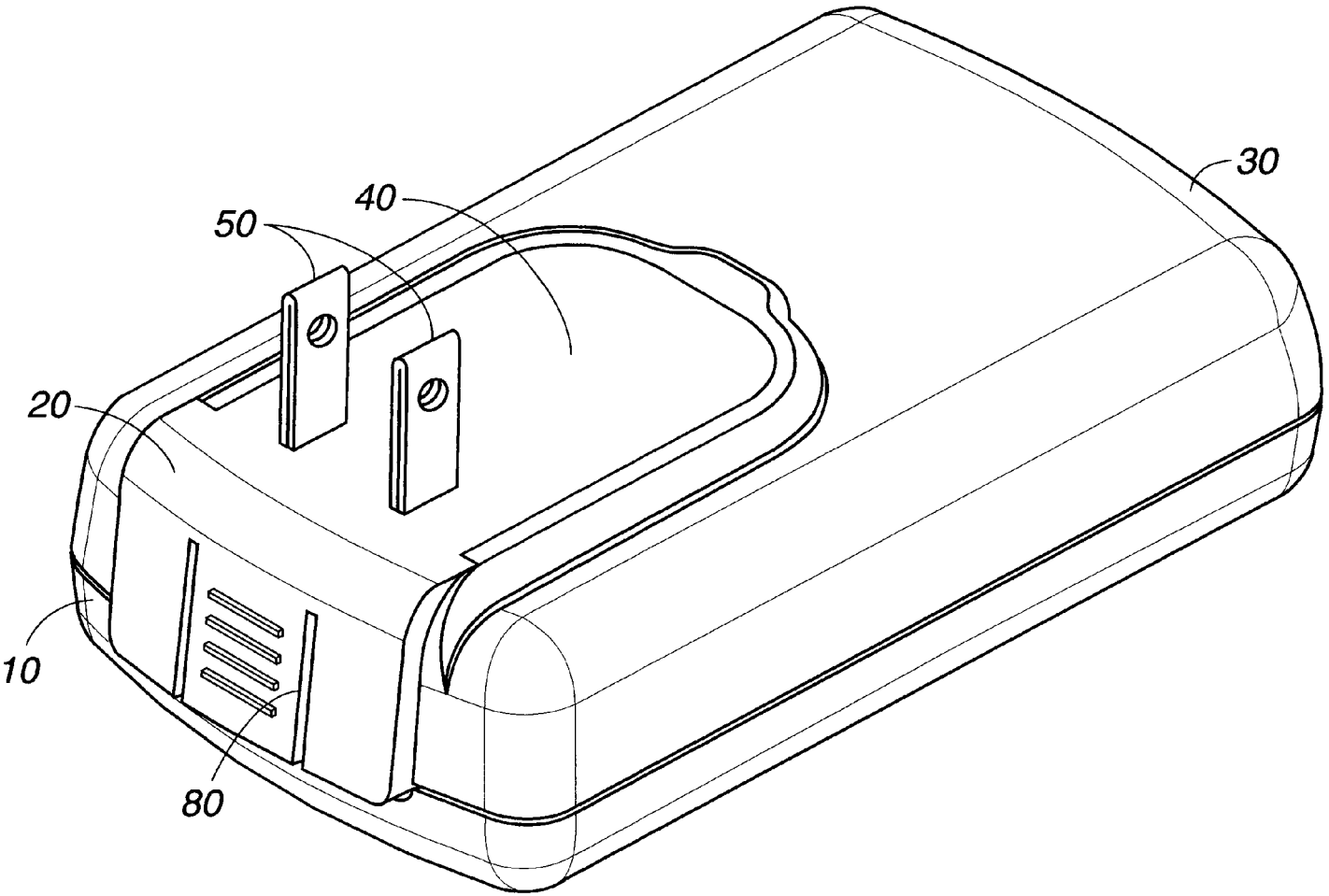
FIG. 3 is a perspective view of the power transformer of the present invention with the adapter plug fitted to the housing.

The present invention provides an international adapter scheme which is compact, easy to use, and elegantly simple. The power transformer of the present invention is shown in a perspective view in FIG. 1. Power transformer (10) consists of adapter plug (20) and housing (30). Adapter face (40) has prongs (50) to fit in a wall outlet (not shown), which here would be an American outlet. Of course, adapter face (40) could just as easily be selected from any of the international plug prong configurations. FIG. 1 shows the power transformer partially assembled. Projection 110 at the side of the adapter is about to be rotated downward into catchment (80) in the side of the housing. FIG. 2 shows the housing (30) of the present invention showing recesses (140) in the face of the housing in which lie male contacts (not shown). Catchment (70) in the face of the housing and catchment (80) in the side of the housing are clearly visible. FIG. 3 shows the power transformer (10) of the present invention with adapter plug (20) fitted securely onto housing (30). Optional grip ridges (170) assist the user in assembling and dissassembling the power transformer (10).

Figure 4:
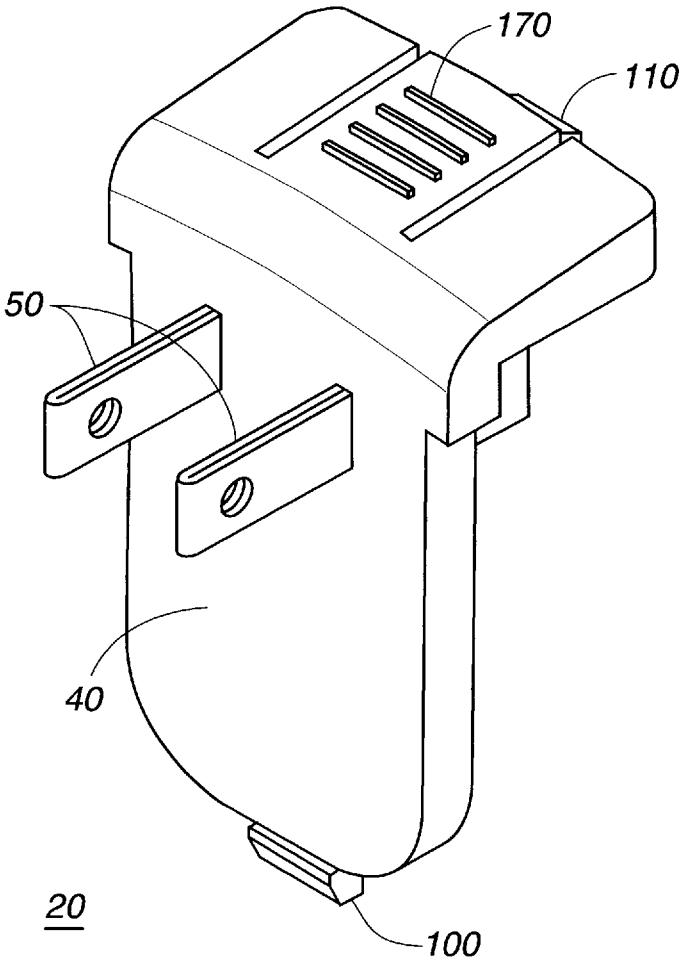
FIG. 4 is a perspective view of the adapter plug of the present invention.
Figure 5:
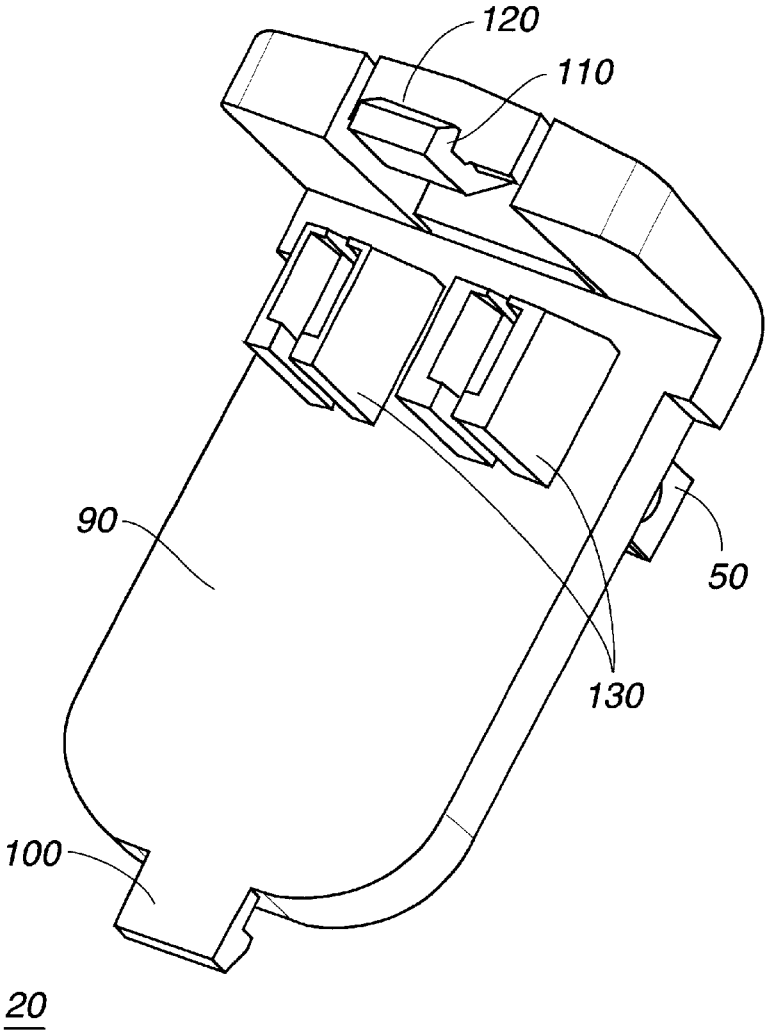
FIG. 5 is a perspective view of the back of the adapter plug of the present invention.
Figure 6:
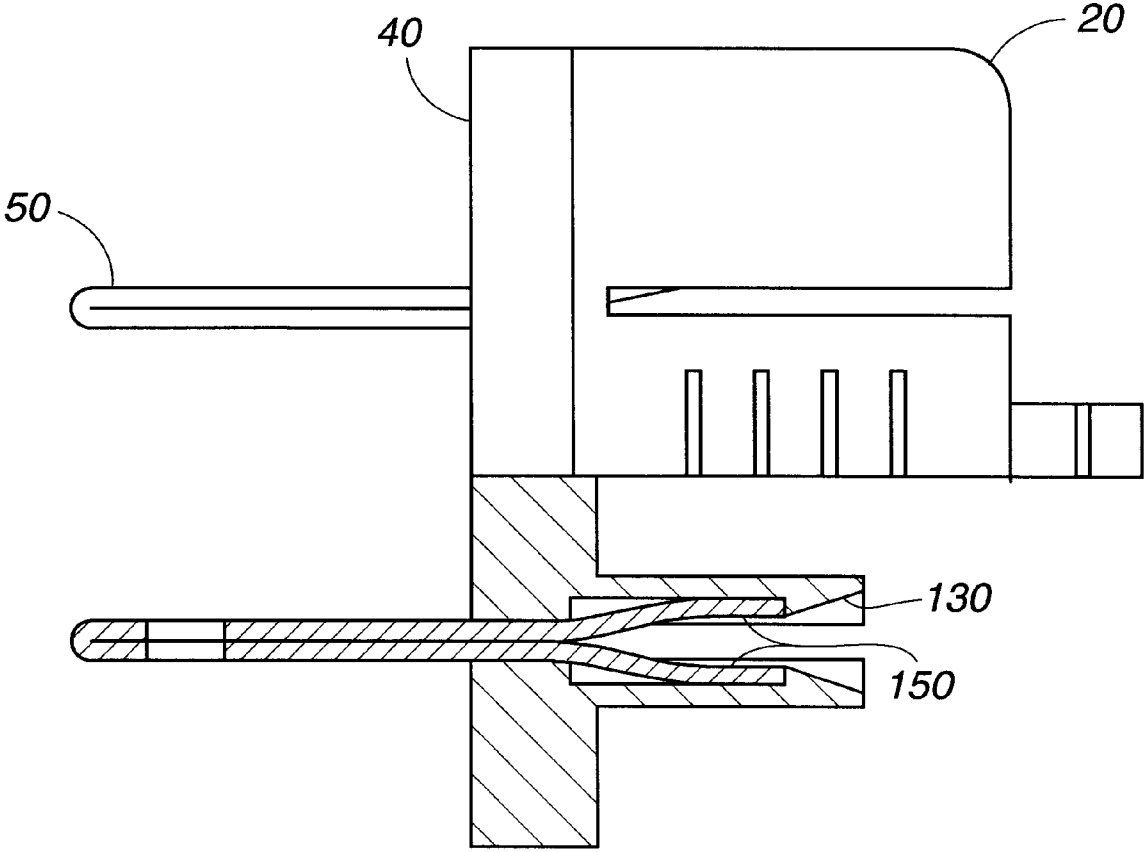
FIG. 6 is a side cut-away view of the adapter plug of the present invention.

FIG. 4 shows a perspective view of adapter plug (20). Projection (100) on the face of the adapter plug and projection (110) on the side of the adapter plug are clearly shown. FIG. 5 shows the back of the adapter plug (20). Again, projection (100) of the face of the adapter and projection (110) of the side of the adapter are clearly shown. In the embodiment of FIG. 5, ridge (120) on the projection (110) on the side of the adapter is shown, which is used to secure the adapter plug (120) to catchment (80) in the side of the housing. Lead-in protrusions (130) surround a female electrical contacts (150) (not shown) in the back (90) of the adapter plug (20). As is evident from FIGS. 1–5, the present invention adheres to the electrical apparatus convention that only female electrical contacts are live. FIG. 6 is a cut-away view of adapter plug (20) showing female electrical contacts (150) which are recessed into the plug.

Figure 7:
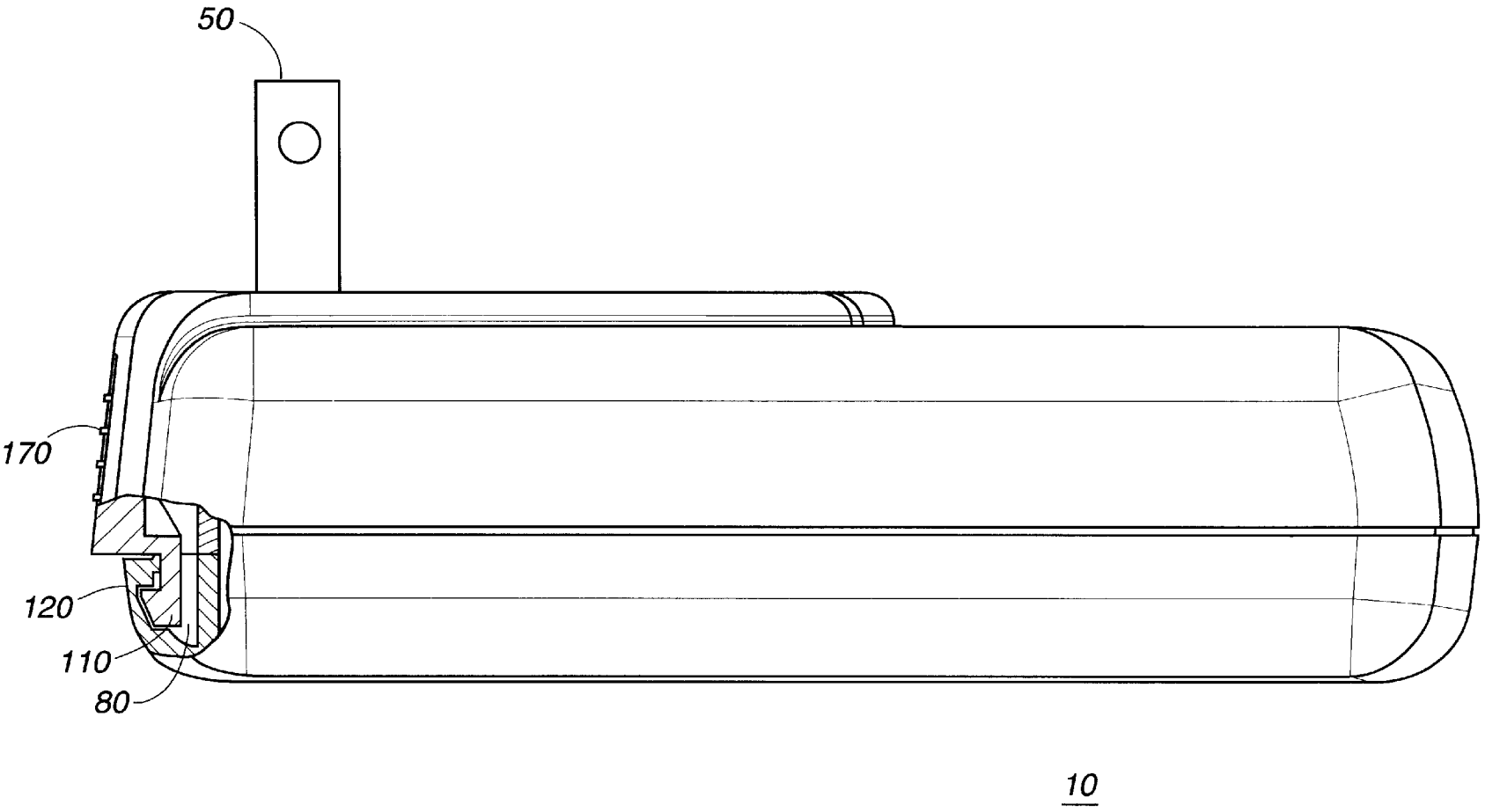
FIG. 7 is a side cut-away view of the power transformer of the present invention.
Figure 8:
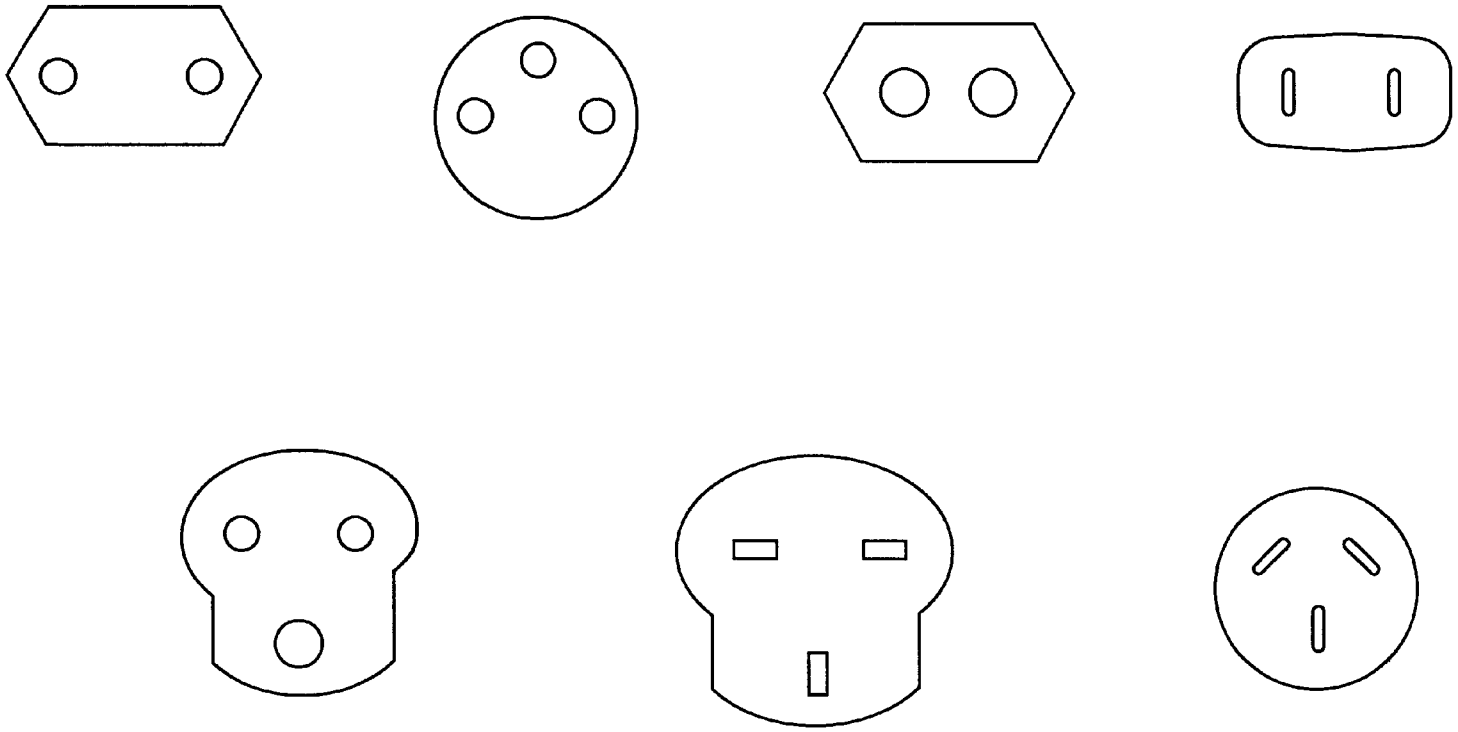
PRIOR ART FIG. 8
FIG. 8 is a front view of various types of plug prong configurations used throughout the world.

FIG. 7 shows the power transformer (10) of the present invention. Adapter plug (20) has been mated to housing (30). This cut-away view shows how the projection (110) at the side of the adapter, and its ridge (120) has mated with the catchment (80)on the side of the housing, preventing unintended release of the adapter plug (20) from the housing (30). In this embodiment, the volume of the catchment (80) is greater than that of the projection (110), so that pressure on grip ridges (170) can free projection (110) from the catchment (80). In this embodiment, pressure at the side (160) of the adapter plug (20) which is directed inward and upward would release adapter plug from housing (30). FIG. 8 shows a variety of international adapter prong configurations, any one of which can be used on the face of adapter plug (20).

In assembling the power transformer (10) of the present invention, the projection (100) at the end of the face of the adapter (40) is first inserted into the catchment (70) in the face (60) of the housing. The back (90) of the adapter is then pushed onto the face (60) of the housing. This causes projection (110) at the side of the adapter to be pushed into the catchment (80) in the side of the housing, and the ridge (120) on the projection at the side end of the adapter is restrained by the catchment (80) in the side of the housing. Thus with a simple insertion, rotation, and snap-fit, the power transformer of the present invention can be assembled.

As can be divined from the above, the present invention provides a power transformer that is easy to use, and is readily transportable, since the different plug faces are relatively small and light-weight.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A power transformer comprising:

(a) a housing with a catchment on its face and a catchment on its side; and (b) an L-shaped adapter plug having a front face with prongs jutting outward from the front side, and having a back side, wherein the back side fits over the face and the side of the housing;

wherein the adapter plug has a projection on its back, and a projection on its side which includes a ridge at tip of the upright portion of the L-shape;

wherein the projection on the side of the adapter plug fits into the catchment on the face of the housing, and the projection on the side of the adapter plug fits into the catchment on the side of the housing and is restrained therein, and wherein a male electrical contact in the face of the housing mates with a female electrical contact within the back side of the adapter plug when the adapter plug is fitted onto the housing;

and wherein the face of the adapter plug comprises a plug configuration selected from the group consisting of international electrical plug configurations.

2. An electrical device comprising the power transformer of claim 1.

* * * * *